United States Patent [19]

Komatsu

[11] Patent Number: 4,802,820

[45] Date of Patent: Feb. 7, 1989

[54] COMPACT TURBINE HOUSING

[75] Inventor: Hiroshi Komatsu, Yokosuka, Japan

[73] Assignee: Nissan Motor Co., Ltd., Japan

[21] Appl. No.: 764,067

[22] Filed: Aug. 9, 1985

[30] Foreign Application Priority Data

Aug. 15, 1984 [JP] Japan ..... 59-169234

[51] Int. Cl.[4] ..... F04D 29/60

[52] U.S. Cl. ..... 415/201; 415/203; 415/219 C

[58] Field of Search ..... 415/201, 219 C, 219 R, 415/203, 204, 205, 206

[56] References Cited

U.S. PATENT DOCUMENTS

| | | | |
|---|---|---|---|
| 2,482,414 | 9/1949 | Gillespie | 415/201 |
| 2,977,088 | 3/1961 | Buchi | 415/201 |
| 3,499,388 | 3/1970 | Eberhardt | 415/201 |
| 3,543,368 | 12/1970 | Marlow | 415/196 |
| 3,824,028 | 7/1974 | Zenkner et al. | 415/219 C |
| 4,678,397 | 7/1987 | Komatsu et al. | 415/151 |

FOREIGN PATENT DOCUMENTS

| | | | |
|---|---|---|---|
| 1281342 | 12/1962 | France | 415/201 |

*Primary Examiner*—Robert E. Garrett
*Assistant Examiner*—John T. Kwon
*Attorney, Agent, or Firm*—Lane and Aitken

[57] ABSTRACT

In order to reduce the overall dimensions of the housing of a turbine which forms a vital part of an exhaust gas powered supercharger (viz., turbocharger), the opening in which a cover member is mounted, is rendered eccentric with respect to the axis of rotation of the turbine impeller in a manner that diameter of the opening can be reduced while still maintaining a surface within the housing which must be precision machined, sufficiently within the shadow of the eccentric opening as to be readily visible and thus permit ready production and assembly of a capacity varying nozzle arrangement which forms a vital part of the device. By reducing the diameter of the opening, the diameter of the cover and the degree to which attachment flanges on the housing and cover extend out from the housing can be notably reduced.

7 Claims, 6 Drawing Sheets

COMPACT TURBINE HOUSING

BACKGROUND OF THE INVENTION

1. Field of the Invention

The present invention relates generally to a turbine housing and more specifically to a turbine housing arrangement which permits the overall dimensions of the device to be reduced without any loss in production ease.

2. Description of the Prior Art

FIGS. 1 and 2 show an example of a prior art turbine housing arrangement 1 which forms part of an automotive turbocharger (viz., a supercharger driven the exhaust gases expelled from the combustion chambers of the engine). This arrangement as shown, includes a variable nozzle 2 for deflecting the exhaust gases which flow from engine in a manner which permits the capacity of the turbine arrangement to variable and the permit high efficiency during both high and low engine speed operation.

Examples of such an arrangement are disclosed in copending U.S. Pat. No.4,678,397 Hiroshi Komatsu et al. The content of this application is hereby incorporated by reference thereto.

However, in order to facilitate easy manufacture, the axes (OA, OB, OC) of (a) the turbine impeller 3, (b) the exhaust port 4 formed in the cover which closes an aperture 5 formed in the housing 6 for the purposes of inserting the impeller 3 and variable nozzle arrangement 2, and (c) the just mentioned aperture 5 have been arranged to coincident as shown. Previously this has been deemed particularly necessary in order to facilitate the precision machining of the surface 7 over which the tongue or vane member 8 of the variable nozzle sweeps—a measure necessary to permit the deflecting vane or tounge 8 to closely juxtapose the wall of the housing 6 and limit the amount of exhaust gas which can leak therebetween.

Accordingly, as will be appreciated from FIG. 1 of the drawings the attachment flange 9 formed at the periphery of the housing is inherently required to extend radially outwardly thus increasing the overall dimensions of the arrangement. Thus, this arrangement encounters the drawback of being bulky and thus difficult to arrange in the very crowded engine compartment of currently produced automotive vehicles.

SUMMARY OF THE INVENTION

It is an object of the present invention to provide a housing arrangement for an automotive supercharger which permits an overall reduction in the size of the arrangement while maintaining the ease with which the device can be manufactured and assembled.

In brief, this object is achieved by an arrangement wherein in order to reduce the overall dimensions of the housing of a turbine which forms a vital part of an exhaust gas powered supercharger (viz., turbocharger), the opening in which a cover member is mounted, is rendered eccentric with respect to the axis of rotation of the turbine impeller in a manner that diameter of the opening can be reduced while still maintaining a surface within the housing which must be precision machined, sufficiently within the shadow of the eccentric opening as to be readily visible and thus permit ready production and assembly of a capacity varying nozzle arrangement which forms a vital part of the device. By reducing the diameter of the opening, the diameter of the cover and thus the degree to which attachment flanges on the housing and cover extend out from the housing can be notably reduced.

More specifically, the present invention takes the form of a turbine arrangement for use in an automotive turbo-charger or the like, which comprises: a housing; a turbine impeller disposed in the housing, the impeller having a first axis about which it is rotatable; means defining a first aperture in the housing, the first aperture having a second axis, the second axis being offset from the first axis, the first aperture casting a shadow into the housing; a cover detachably secured to the housing in a manner which closes the first aperture; means defining an exhaust port in the cover, the exhaust port having an axis coincident with the first axis; means defining a scroll passage in the housing, the scroll passage being arranged to direct gases toward the impeller; a variable nozzle located at the downstream end of the scroll passage for variably throttling the flow of gases flowing though the scroll passage from an inlet port toward the impeller, the variable nozzle including a vane pivotally mounted on one of the housing and the cover, the vane being pivotal between first and second extreme positions; means defining a precision machined surface in the housing, the precision machined surface being arranged immediately adjacent an edge of the vane and in an area over which the vane sweeps as it pivots from the first extreme position to the second extreme position, the precision machined surface being located so that at least the portion thereof which is closest to the impeller lies in the shadow of the first aperture.

BRIEF DESCRIPTION OF THE DRAWINGS

The features and advantages of the arrangement of the present invention will become more clearly understood from the following description taken in conjunction with the accompanying drawings in which.

DETAILED DESCRIPTION OF THE PREFERRED EMBODIMENTS

Figure 1:
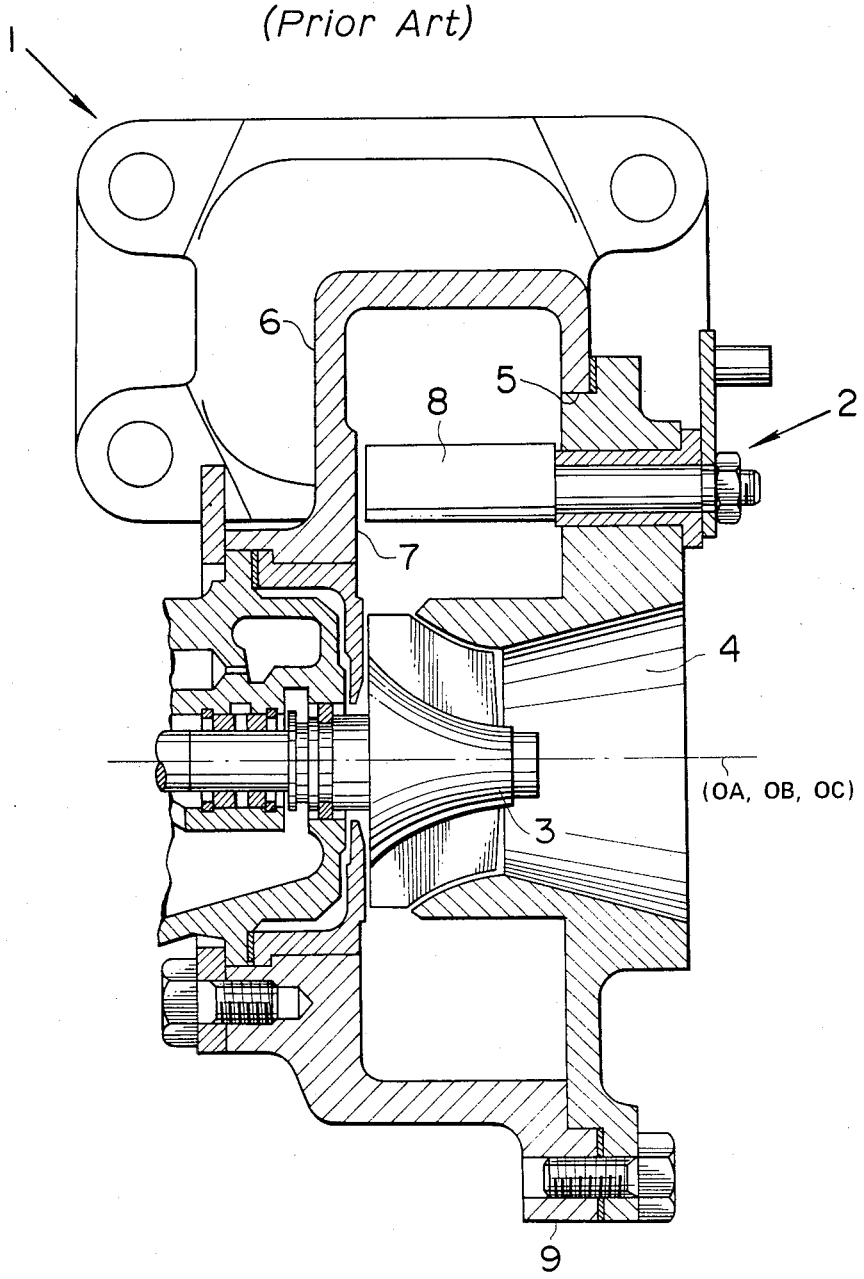
FIG. 1 (Prior Art)
FIG. 1 is a sectional elevation of the prior art arrangement discussed in the opening paragraphs of the instant disclosure.
Figure 2:
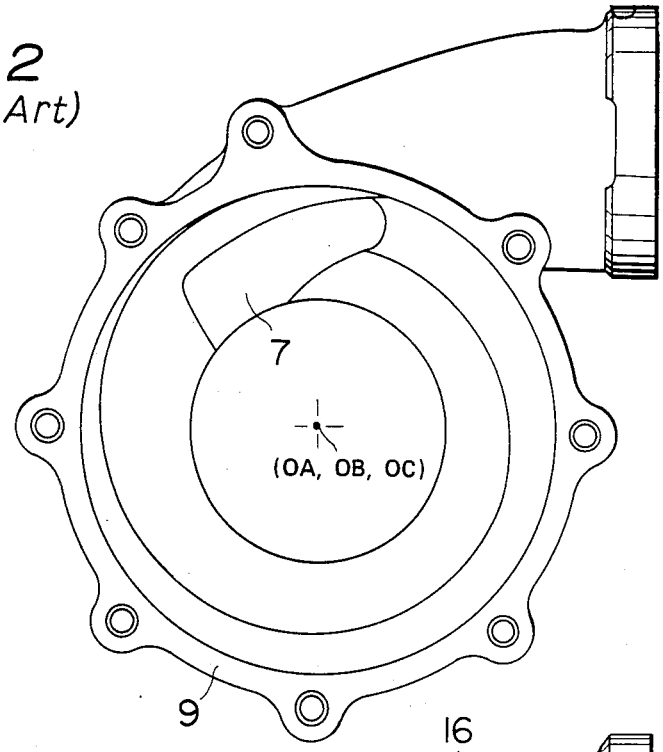
FIG.2 (Prior Art)
FIG. 2 is a front elevation of the housing shown in FIG. 1.
Figure 4:
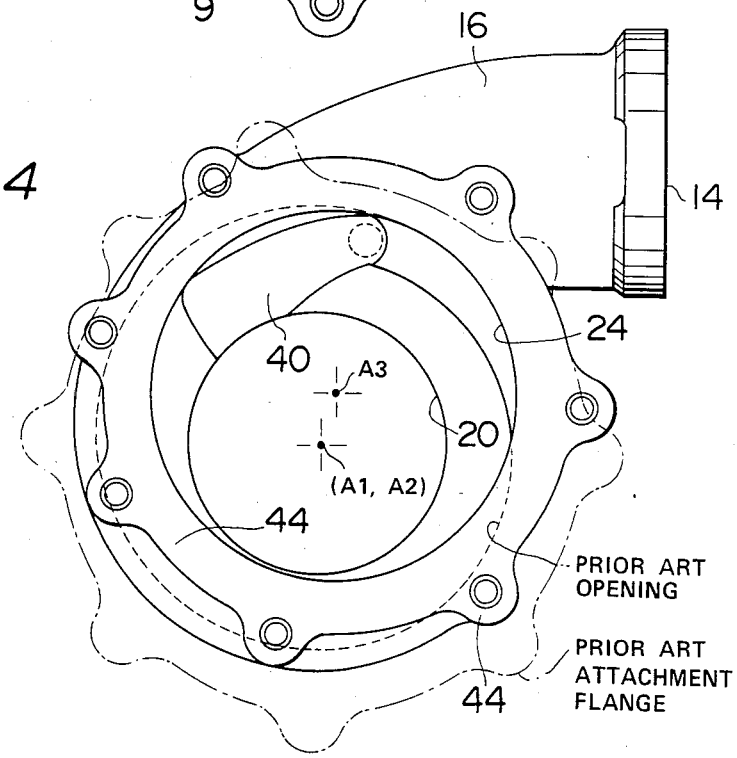
FIG. 4 is a front elevation of the housing which forms part of the first embodiment.
Figure 3:
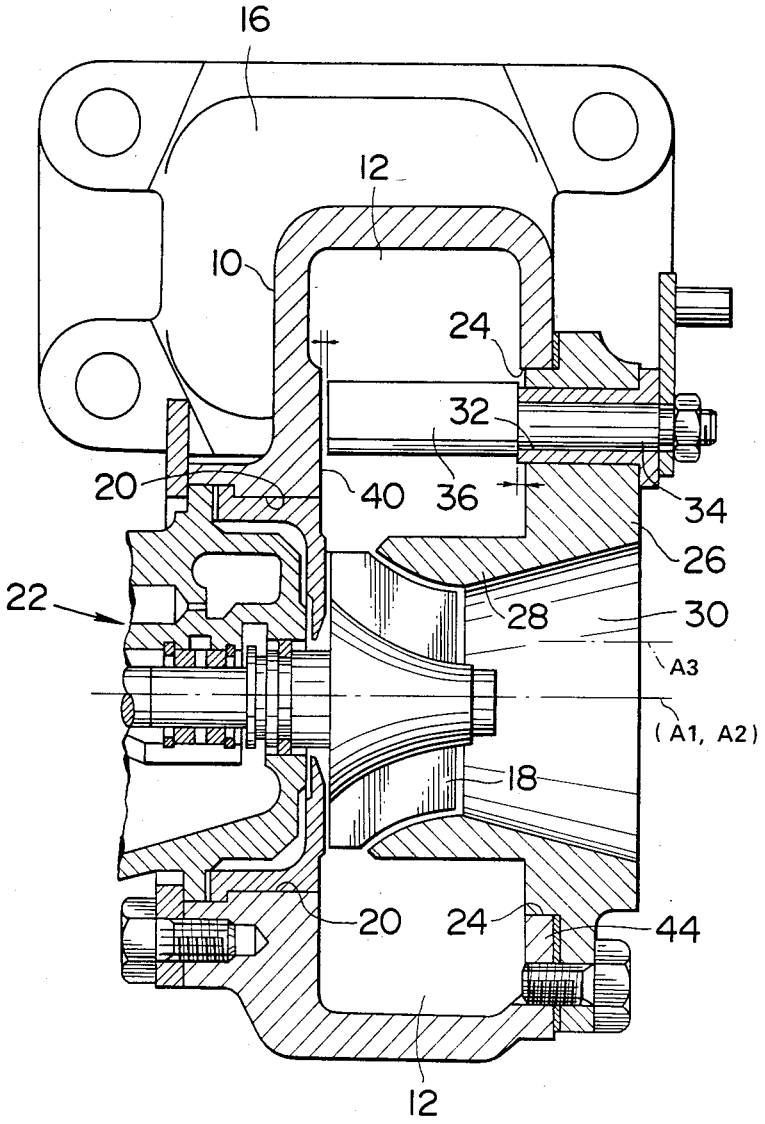
FIG. 3 is a sectional elevation of a first embodiment of the present invention.

FIGS. 3 and 4 show a first embodiment of the present invention. In this arrangement a turbine housing 10 is formed so as to include a convolute scroll passage 12 which leads from an inlet port 14 (see FIG. 4), formed in a runner like section 16 which is adapted to secured to an exhaust manifold or the like of an internal combustion engine or the like (not shown) to a site whereat the turbine impeller 18 is mounted. The housing is formed with a aperture 20 in which the turbine impeller bearing assembly 22 is detachably secured. In this embodiment the axis A1 of this first aperture is arranged to be coincident with the axis of rotation A2 of the impeller 18. The housing 10 is formed with a second aperture 24 which is closed by a cover member 26. This cover 26 is formed with an annular member 28 which surrounds the downstream section of the impeller 18 and which defines an exhaust port 30 via which the gases are exhausted after having passed through the impeller 18. Although not shown, an exhaust conduit is arranged to communicate with port 30 for the purposes of conducting the waste gases to a muffler or purifying device or both before being vented to the atmosphere.

Figure 5:
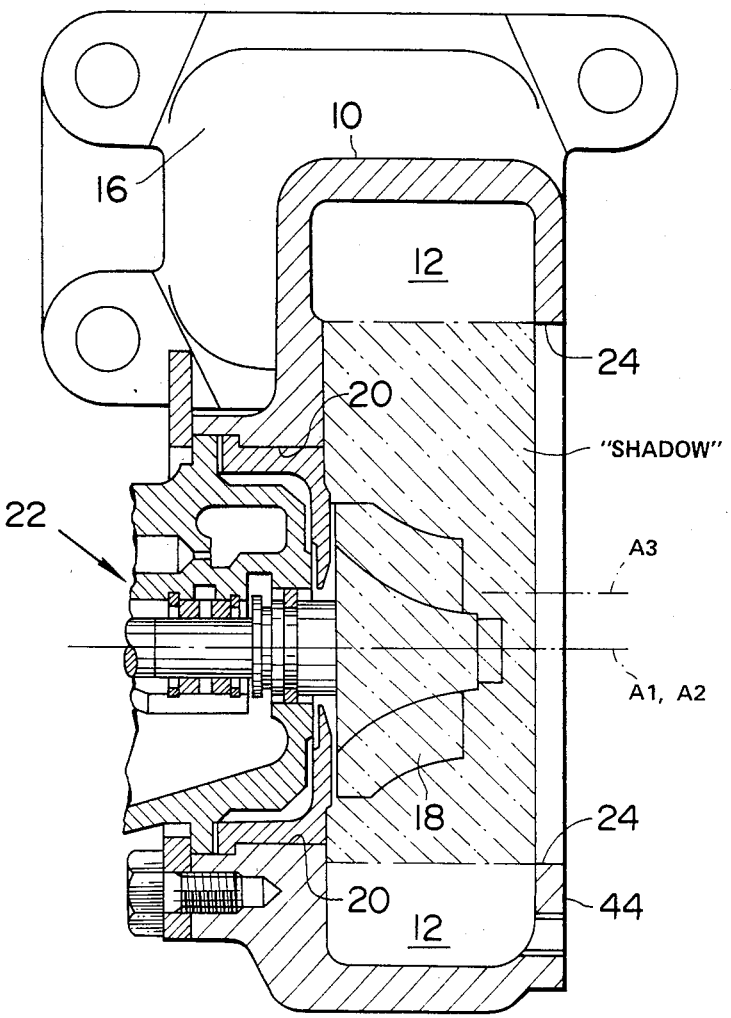
FIG. 5 is a sectional elevation similar to that shown in FIG. 3 but wherein the cover is removed from the housing and the "shadow" of the opening formed in the cover shown by hatching.

As best seen in FIGS. 4 and 5, the axis A3 of the second aperture (viz., that closed by the cover member 26) is eccentric with respect to that in which the impeller bearing assembly is disposed. The reason for this will become clearer hereinlater.

In this embodiment the cover member 26 is formed with a bore (no numeral) in which a bearing or bush member 32 is disposed. As shown, this bearing is arranged to journal a shaft 34 on which a deflection vane or tounge 36 is carried. The bush or bearing is arranged to project slightly beyond the inner wall of the cover member so as to define a predetermined clearance (no numeral) between the edge of the vane 36 closest to the cover member 26 and the cover member. In order to minimize this clearance in a manner which maximizes the labyrinth seal-like effect produced by same without encountering any sticking or jamming it is necessary to precision machine both the edge of the vane 36 and the area of the cover membrr 26 over which the vane 36 sweeps during operation. It is similarly necessary to precision machine the other edge of the vane 36 and the juxtaposed surface 40 of the housing over which the vane 36 sweeps during operation in order to minimize the clearance (no numeral) therebetween.

In order to perform the machining of the latter mentioned surface 40 it is necessary to arrange for the opening 24 into which the cover member 26 is disposed to be sufficiently large as to allow for the necessary machine tools to be readily inserted into the housing and for the operator to see the surfaces which require a high degree of finishing. Accordingly, with the prior art arrangement the opening has been formed as shown in broken line and the peripheral flange which facilitates the attachment of the cover to the housing arranged to extend as shown in phantom line. As previously pointed out, this causes the arranged to be overly bulky and difficult to dispose in very cramped engine compartments.

However, with the present invention, as opening 24 is arranged eccentrically with respect to the impeller 18 and exhaust port 30 (viz., the axis A3 of opening is as shown in FIG. 4 displaced from those (A1, A2) of the impeller 18 and exhaust port 30 in the general direction of the axis about which the vane 36 is pivotal) it is possible to both reduce the diameter of the opening 24 while maintaining the surface 40 to be machined sufficiently within the shadow of the opening (see FIG. 5 wherein the shadow, as will be referred to throughout this specification, is shown in hatching) that machining thereof is readily performable with no loss in production efficiency being encountered. Moveover, the small diameter and eccentricity of opening renders it possible to arrange for the attachment flange 44 located on the side of the housing opposite to that on which surface 40 is located, to extend inwardly toward the axis of rotation A2 of the impeller 18 rather than away from same. Accordingly, a very notable decrease in the overall dimensions of the housing arrangement is possible as will be fully appreciated from FIG. 4.

Figure 6:
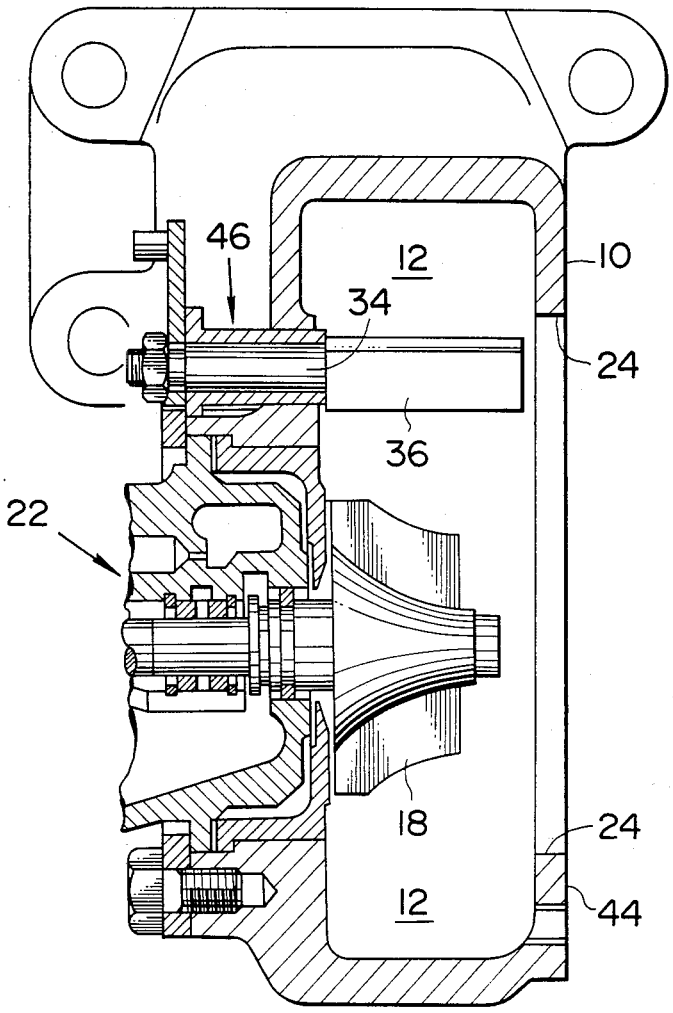
FIG. 6 is a sectional elevation similar to that shown in FIG. 3 but which illustrates a second embodiment wherein the vane or tounge member which forms a vital part of variable volume nozzle arrangement is pivotally mounted on the housing rather than on the cover member.

FIG. 6 shows an embodiment of the present invention wherein the vane 36 is pivotally mounted via a bearing arrangement 46 formed in the housing 10 rather than the cover member 26. As will be appreciated it is advantageous in this embodiment also to ensure that the bore in which the vane support bearing is disposed is within the shadow of opening 24 so as to facilitate easy insertion of the shaft 34 into the support bearing.

Figure 7:
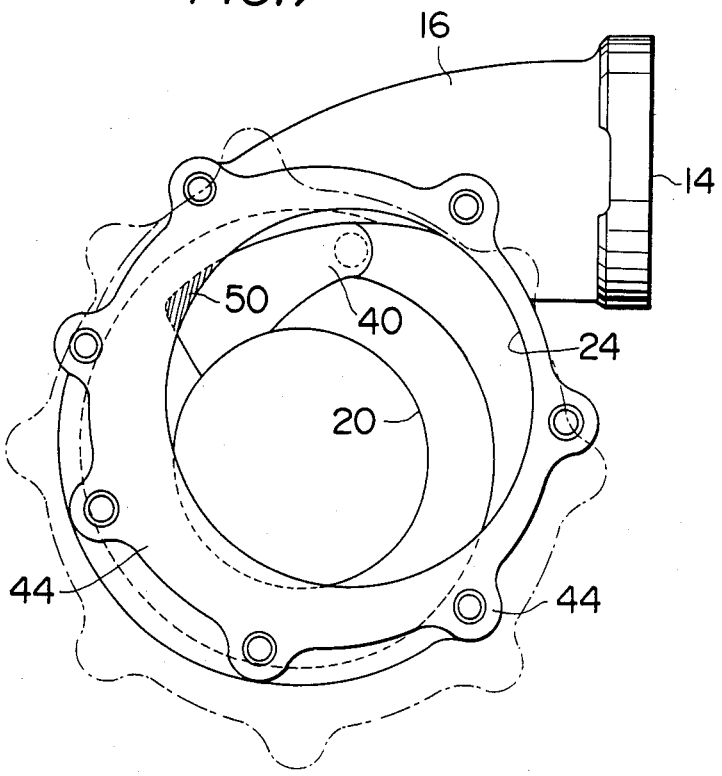
FIG. 7 shows a third embodiment of the present invention wherein the opening formed in the housing is sufficiently eccentric with respect to the impeller as to conceal part of the area which must be precision machined.
Figure 8:
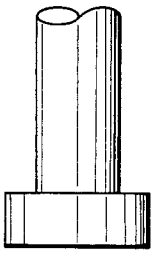
FIG. 8 shows a tool having a shape suitable for maching the arrangement shown in FIG. 7.

As will be appreciated it is not necessary to ensure that the entire area over which the vane 36 sweeps falls within the shadow of opening 24 for the purposes of assembly in that it is possible to rotate the vane 36 toward the impeller 18 to allow for ready assembly. Viz., as shown in FIG. 7 is it possible to arrange for the opening to be such that a part of area 50 (shown in hatching in FIG. 7) is not included in the aforementioned shadow. Viz., it is possible to use a tool having a shape such as shown in FIG. 8 to machine that part of the surface which is not exposed.

What is claimed is:

1. A turbine arrangement for use in an automotive turbo-charger or the like, comprising:

a housing;

a turbine impeller disposed in said housing, said impeller having a first axis about which it is rotatable;

means defining a first aperture in said housing, said first aperture having a second axis, said second axis being offset from said first axis, said first aperture casting a shadow into said housing;

a cover detachably secured to said housing in a manner which closes said first aperture;

means defining an exhaust port in said cover, said exhaust port having an axis coincident with said first axis;

means defining a scroll passage in the housing, said scroll passage being arranged to direct gases from an inlet port toward said impeller;

a variable nozzle located at the downstream end of said scroll passage for variably throttling the flow of gases flowing though said scroll passage from an inlet port toward said impeller, said variable nozzle including a pivotally mounted vane, said vane being pivotal between first and second extreme positions;

means defining a precision machined surface in said housing, said precision machined surface being arranged immediately adjacent an edge of said vane and in an area over which said vane sweeps as it pivots from said first extreme position to said second extreme position, said precision machined surface being located so that at least the portion thereof which is closest to said impeller lies in the shadow of said first aperture.

2. A turbine arrangement as claimed in claim 1, further comprising:

means defining a bore in one of said housing and said cover, said cover being arranged to journal a shaft on which said vane is mounted, said bore being arranged to be in the shadow of said first aperture.

3. A turbine arrangement as claimed in claim 2, wherein said second axis is displaced from said first axis essentially in the direction of the shaft on which said vane is mounted.

4. In a turbocharger a turbine comprising:

a housing into which exhaust gases are introduced through an inlet;

an impeller disposed in the housing, said impellar being arranged to be driven to rotate about an axis by said exhaust gases;

an opening formed in said housing, said opening having a center which is eccentric with respect to the axis about which said impeller is rotatable;

a cover disposed in said opening to close the same;

means defining an exhaust port in said cover through which exhaust gases can be exhausted from said housing, said exhaust port being arranged to be eccentric with respect to the center of said cover and concentric with said respect to said axis about which said impellar is rotatable, said exhaust port being defined in part within an inwardly extending flange which is integral with said cover and which surrounds a part of said impellar.

5. A turbine as claimed in claim 4 further comprising:

an exhaust gas flow deflection vane, said vane being pivotally mounted in said housing and arranged to be pivotal through a predetermined angle, said vane defining a variable nozzle for variably throttling the flow of exhaust gases which are flowing from said inlet toward said impellar; and a precision machined surface in said housing, said surface being located immediately adjacent a side edge of said vane and located so that at least a portion of said surface lies in the shadow of said opening.

6. A turbine as claimed in claim 5 further comprising:

means defining a bore in one of said housing and said cover, said bore journalling a shaft on which said vane is pivotally supported.

7. A turbine as claimed in claim 4 further comprising:

an attachment flange formed on said cover, said attachment flange being formed with a plurality of bolt holes through which bolts can be disposed and threadedly received in threaded bores formed in said housing, said cover and said attachment flange being arranged with respect to said housing so that said housing can be rendered compact.

* * * * *